US005208944A

United States Patent [19]

Lu

[11] Patent Number: 5,208,944

[45] Date of Patent: May 11, 1993

[54] HINGE DEVICE FOR CASINGS

[76] Inventor: Sheng N. Lu, No. 174, Chun Ying St., Shu Lin Chen, Taipei Hsien, Taiwan

[21] Appl. No.: 899,293

[22] Filed: Jun. 16, 1992

[51] Int. Cl.[5] ..... E05F 1/08; E05C 17/64; E05D 11/08

[52] U.S. Cl. ..... 16/278; 16/340

[58] Field of Search ..... 16/278, 340

[56] References Cited

U.S. PATENT DOCUMENTS 1,644,249 10/1927 Harrison ..... 16/340
1,896,057 1/1933 Sheard ..... 16/340
4,829,633 5/1989 Kassner ..... 16/340

*Primary Examiner*—John Sipos
*Assistant Examiner*—Carmine Cuda
*Attorney, Agent, or Firm*—Oblon, Spivak, McClelland, Maier & Neustadt

[57] ABSTRACT

A hinge device for a casing of the type having a body portion and an upper cover includes a substantially L-shaped mount plate adapted to be securely mounted to the body portion of the casing, two washers respectively attached to both sides of the mount plate, a pivotal axle having a mounting portion adapted to be securely mounted to the upper cover of the casing, an extension pivotally received in a hole of the mount plate, a spring member mounted on the extension of the pivotal axle, a sleeve member, a torsion spring mounted on the sleeve member, a follower securely mounted on the extension, and a nut mounted on a threaded end portion of the extension. The nut biases the spring and allows the pivotal axle to be freely pivotable relative to the spring. When a desired position of the upper cover relative to the body portion of the casing is reached, the spring member biased by the nut exerts a longitudinal force on the pivotal axle to retain the pivotal axle in position. Furthermore, the stop of the follower slightly biases the torsion spring when the casing is in a locked status. The stop contacts an arm of the torsion spring when the upper cover is in a pre-set maximum angle relative to the body portion of the casing.

4 Claims, 2 Drawing Sheets

HINGE DEVICE FOR CASINGS

BACKGROUND OF THE INVENTION

The present invention relates to a hinge device for casings and, more particularly, to an improved hinge device for casings of the type comprised of an upper cover and a body portion.

Many hinge devices are used in casings, such as portable computers, of the type having an upper cover and a body portion, to discretionally retain the upper cover in a desired position relative to the body portion by friction. However, such hinge devices tend to malfunction after long-term usage. For example, one type of the hinge devices utilizes a spring around a pivotal axle, and achieve the above-mentioned purpose by means of the friction between the tightly-contacted surface of an inner periphery of the spring and an outer periphery of the pivotal axle. However, after long-term usage, the spring and the pivotal axle are unable to provide sufficient tight contact relationship therebetween due to abrasion.

Therefore, there has been a long and unfulfilled need for an improved hinge device to mitigate and/or obviate the aforementioned problems.

SUMMARY OF THE INVENTION

The present invention provides a hinge device for a casing having a body portion and an upper cover, including a substantially L-shaped mount plate, two washers, a pivotal axle, a spring means, a sleeve member, a torsion spring, a follower, and a nut. The L-shaped mount plate has a vertical portion to which the washers are respectively mounted on both sides thereof and a horizontal portion adapted to be securely mounted to the body portion of the casing. The pivotal axle includes a mounting portion located at a first side of the vertical portion and adapted to be securely mounted to the upper cover of the casing, a flange portion abutting the washer located on the first side of the vertical portion, and an extension fittingly and pivotably received in a hole of the vertical portion. The spring means is mounted around the extension of the pivotal axle. The sleeve member is also mounted around the extension adjacent to the spring means, having a tubular portion around which the torsion spring is mounted. The follower is securely mounted on the extension of the pivotal axle and has a stop to bias the torsion spring when the casing is in a lock position and to define a maximum opening angle when the stop contacts an arm of the torsion spring. The nut is mounted on a threaded end portion of the extension to bias the spring means between the sleeve member and the washer located on the second side of the vertical portion.

Under such an arrangement, the pivotal axle is freely pivotable relative to the spring means. When a desired position of the upper cover relative to the body portion of the casing is reached, the spring means biased by the nut exerts a longitudinal force on the pivotal axle, such that the flange portion of the pivotal axle is tightly against the washer located on the first side of the vertical portion, thereby retaining the pivotal axle in position.

Other advantages and novel features of the invention will become more apparent from the following detailed description when taken in conjunction with the accompanying drawings.

DETAILED DESCRIPTION OF THE PREFERRED EMBODIMENTS

Figure 1:
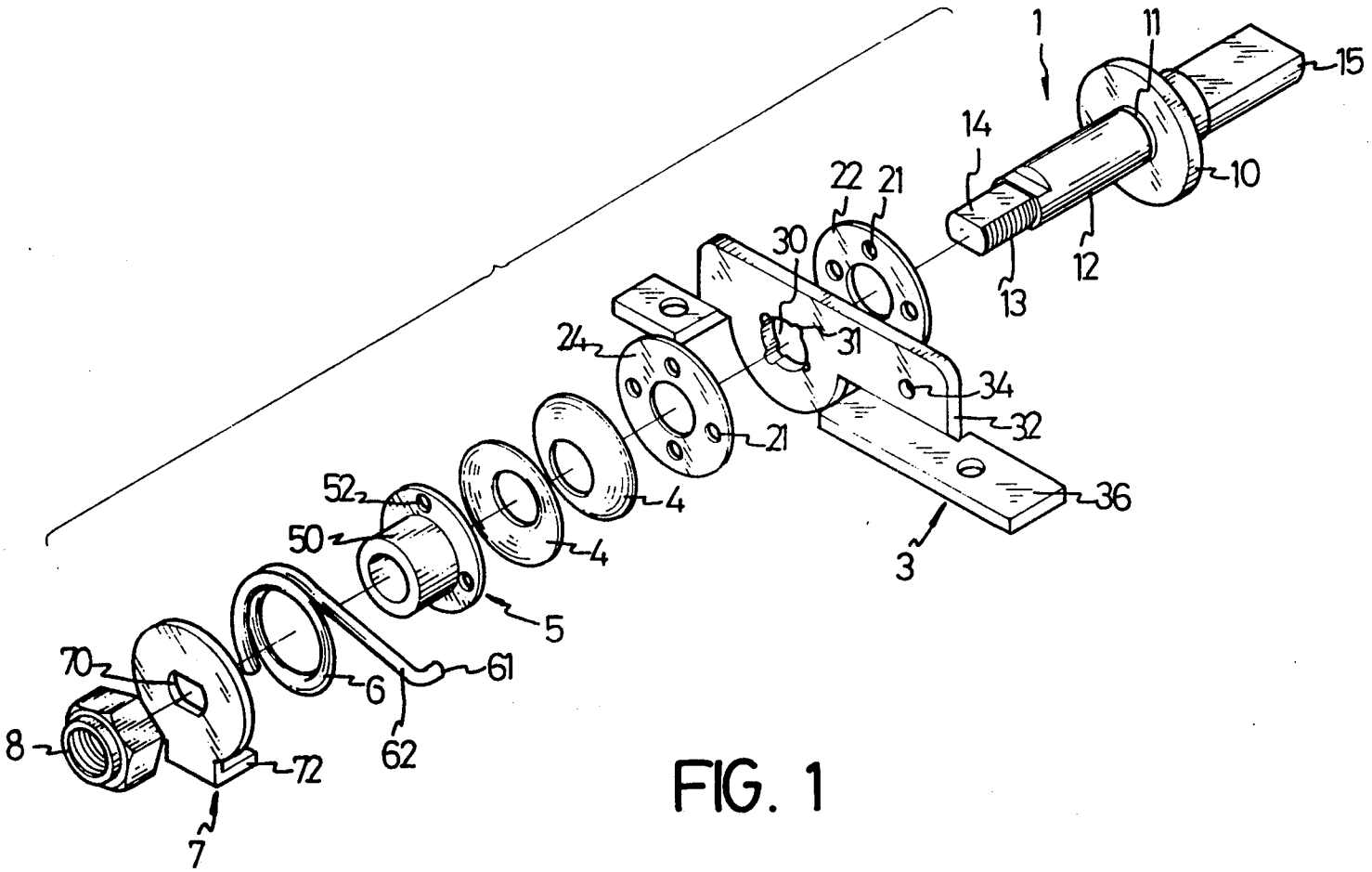
FIG. 1 is an exploded view of a hinge device in accordance with the present invention.
Figure 2:
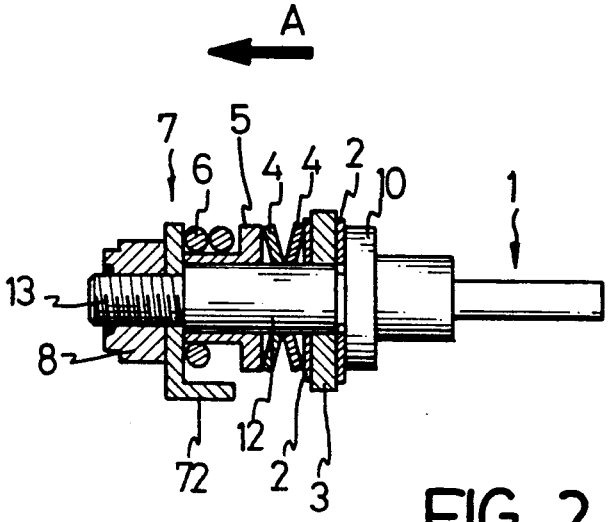
FIG. 2 is a partial cross-sectional view of the hinge device.

Referring to the drawings and initially to FIGS. 1 and 2, a hinge device in accordance with the present invention generally includes a substantially L-shaped mount plate 3 which has a vertical portion 32 with a hole 30 and a horizontal portion 36 adapted to be securely mounted to a body portion of a casing (not shown), such as a portable computer or the like.

The hinge device further has a pivotal axle 1 passing through the hole 30. The pivotal axle 1 includes a mounting portion 15 adapted to be securely mounted to an upper cover (not shown) of the above-mentioned casing, a flange portion 10, and an extension 12 fittingly and pivotably received in the hole 30 of the vertical portion 32. The extension 12 has a threaded end portion 13. The hinge device further has two washers 22 and 24 respectively mounted on both sides of the vertical portion 32, a spring means consisting of two disc-like springs 4, a sleeve member 5, a torsion spring 6, a follower 7 having a stop 72 securely mounted on the extension 12 of the pivotal axle 1, and a nut 8. The sleeve member 5 has a tubular portion 50 around which the torsion spring 6 is mounted and a flange 52 contacting the spring means 4. The torsion spring 6 is mounted around the outer periphery of the tubular portion 50 of the sleeve member 5 with one end 61 of an arm 62 thereof received in a hole 34 in the vertical portion 32.

As clearly shown in FIG. 2, the pivotal axle 1 passes through the hole 30 with the mounting portion 15 and the flange portion 10 thereof located on a first side of the vertical portion 32 and with a part of the extension 12 thereof pivotally received in the hole 30. Furthermore, the threaded end portion 13 is on the other side of the vertical portion 32 of the mount plate 3. Directly attached to the other side of the vertical portion 32 of the mount plate 3 is the other washer 24. Thereafter, the spring means 4 is mounted around the extension 12 of the pivotal axle 1. Then the sleeve member 5 with the torsion spring 6 mounted therearound is also mounted around the extension 12. Thereafter, the follower 7 and the nut 8 are assembled on the threaded end portion 13. The nut 8 is screwed inward to bias the spring means 4.

When a user intends to open the casing, the upper cover thereof is opened by means of a pivotal movement of the pivotal axle 1 relative to the mount plate 3. During the pivotal movement, the pivotal axle 1 is freely pivotable relative to the spring means 4. When a desired position of the upper cover relative to the body portion of the casing is reached, the user releases the upper cover and the upper cover is positioned. This is because the spring means 4 which is biased by the nut 8 exerts a longitudinal force (as indicated by the arrow A in FIG. 2) on the pivotal axle 1 (since the vertical portion 32 is fixed), such that the flange portion 10 of the pivotal axle 1 is tightly against the washer 22 and such a force is sufficient to retain the pivotal axle 1 in position.

Figure 3:
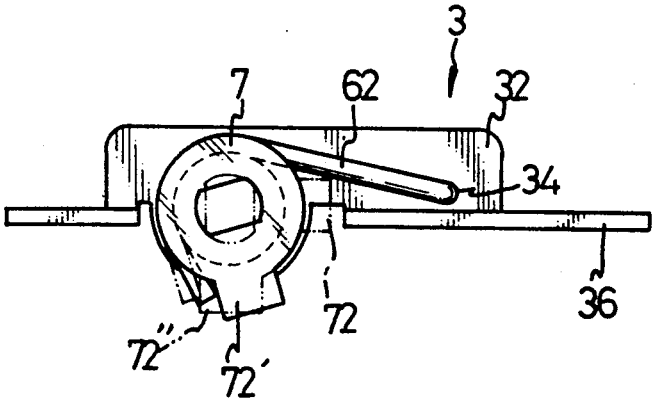
FIG. 3 is a schematic side view of the hinge device.

Referring now to FIG. 3, when the casing is locked (e.g. by a lock usually used in a suitcase), the stop of the follower 7 is in a position represented by reference character 72'', in which case the torsion spring 6 is slightly biased. When the user wishes to open the casing and thus presses a button (not shown) to unlock the upper casing and the body portion thereof, due to the spring force of the torsion spring 6, the upper cover together with the follower 7 are moved to a position represented by 72', thereby facilitating the subsequent opening of the upper cover which has been described in the above paragraph. The reference character 72 represents the maximal opening angle of the upper cover relative to the body portion of the casing, in which case the stop of the follower 7 contacts the arm 62 of the torsion spring 6.

Additionally, oil grooves 31 extending outward from the hole 30 may be provided to give a smooth pivotal movement. Oil holes 21 may be provided in the washers 22 and 24 to provide a smooth contact surface between the washers 22 and 24 and the vertical portion 32 of the mount plate 3. Furthermore, an annular oil groove 11 may be formed in the extension 12 adjacent to the flange portion 10 to provide a smooth pivotal movement of the pivotal axle 1 relative to the vertical portion 32 of the mount plate 3. It is appreciated that the oil in the grooves 11, 21, and 31 provides several functions: (1) providing a smooth operation, (2) absorbing heat generated during operation, and (3) eliminating noise that may occur during operation.

In the embodiment of the present invention the threaded end portion 13 is cut to form two opposite planar surfaces 14, and the follower 7 has a corresponding hole 70. Nevertheless, it is appreciated that many other modifications can be made without departing from the principle of the invention.

Although the invention has been explained in relation to its preferred embodiment, it is to be understood that many other possible modifications and variations can be made without departing from the spirit and scope of the invention as hereinafter claimed.

I claim:

1. A hinge device for a casing having a body portion and an upper cover, comprising:

a substantially L-shaped mount plate having a vertical portion with a first hole and a second hole and a horizontal portion adapted to be securely mounted to said body portion of said casing;

a pivotal axle comprising a mounting portion located on a first side of said vertical portion and adapted to be securely mounted to said upper cover of said casing, a flange portion also located on said first side of said vertical portion, and an extension with a portion thereof fittingly and pivotally received in said first hole of said vertical portion of said mount plate and having a threaded end portion;

a first washer mounted on said extension of said pivotal axle and attached to said first side of said vertical portion of said mount plate between said vertical portion and said flange portion;

a second washer mounted on said extension of said pivotal axle and attached to a second side of said vertical portion of said mount plate;

a spring means mounted around said extension of said pivotal axle;

a sleeve member mounted on said extension adjacent to said spring means, having a tubular portion and a flange;

a torsion spring mounted on said tubular portion of said sleeve member, said torsion spring having an arm with a distal end thereof securely attached to said second hole in said vertical portion, a follower securely mounted on said threaded end portion of said pivotal axle for rotation therewith, said follower having a stop slightly biasing said torsion spring when the upper cover and the body portion is in a locked position, and said stop contacting said arm when the upper cover is opened to a pre-set maximum angle relative to the body portion; and a nut mounted on said threaded end portion of said extension to bias said spring between said member and said second washer;

whereby said pivotal axle is freely pivotable relative to said spring means, when a desired position of said upper cover relative to said body portion of said casing is reached, said spring means biased by said nut exerts a longitudinal force on said pivotal axle, such that said flange portion of said pivotal axle is tightly against said first washer, thereby retaining said pivotal axle in position.

2. The hinge device as claimed in claim 1, wherein at least one oil groove is formed in said hole to provide a smooth pivotal movement.

3. The hinge device as claimed in claim 1, wherein at least one oil hole is provided in each said washer to provide a smooth contact surface between each said washer and said vertical portion of said mount plate.

4. The hinge device as claimed in claim 1, wherein said extension has an annular groove adjacent to said flange portion.

* * * * *